US010513133B2

(12) United States Patent
Czyzewski et al.

(10) Patent No.: US 10,513,133 B2
(45) Date of Patent: Dec. 24, 2019

(54) TEXT CONCEALING TOOL ASSEMBLY

(71) Applicants: Joseph Czyzewski, Virginia Beach, VA (US); Anca Czyzewski, Virginia Beach, VA (US)

(72) Inventors: Joseph Czyzewski, Virginia Beach, VA (US); Anca Czyzewski, Virginia Beach, VA (US)

( * ) Notice: Subject to any disclaimer, the term of this patent is extended or adjusted under 35 U.S.C. 154(b) by 0 days.

(21) Appl. No.: 15/947,146

(22) Filed: Apr. 6, 2018

(65) Prior Publication Data

US 2019/0308431 A1 Oct. 10, 2019

(51) Int. Cl.

| | |
|---|---|
| ***B41K 1/00*** | (2006.01) |
| ***B41K 1/22*** | (2006.01) |
| ***B26F 1/24*** | (2006.01) |
| ***B26F 1/08*** | (2006.01) |
| ***B41K 1/42*** | (2006.01) |

(52) U.S. Cl.

CPC ..... *B41K 1/22* (2013.01); *B26F 1/08* (2013.01); *B26F 1/24* (2013.01); *B41K 1/42* (2013.01)

(58) Field of Classification Search

CPC ..... B26F 1/08; B26F 1/10; B26F 1/24; B41K 1/42; B41K 3/36; B41F 19/02; B41F 19/08; B41M 1/24

See application file for complete search history.

(56) References Cited

U.S. PATENT DOCUMENTS

| | | | | | |
|---|---|---|---|---|---|
| 1,843,098 | A | | 1/1932 | McKee | |
| 2,451,595 | A | * | 10/1948 | Wheeler | B25H 7/04 101/114 |
| 3,006,273 | A | * | 10/1961 | Sommer | G01B 3/12 101/114 |
| 3,167,009 | A | * | 1/1965 | Sloane | B41K 1/22 101/329 |
| 4,593,618 | A | * | 6/1986 | Lebensfeld | B41K 1/22 101/375 |
| 4,817,526 | A | * | 4/1989 | Winston | B41K 1/22 101/329 |
| 5,303,648 | A | * | 4/1994 | Shih | B41K 1/22 101/327 |
| 5,435,245 | A | | 7/1995 | Salisbury et al. | |
| 5,505,133 | A | * | 4/1996 | Chen | B41K 1/22 101/368 |
| 5,732,627 | A | * | 3/1998 | Imamaki | B41K 1/22 101/116 |
| 6,360,658 | B1 | * | 3/2002 | Benson | B41J 1/22 101/109 |
| 6,659,007 | B1 | * | 12/2003 | Winston | B41K 1/22 101/329 |
| 7,104,196 | B1 | * | 9/2006 | Fong | B41K 1/22 101/106 |

(Continued)

FOREIGN PATENT DOCUMENTS

| | | | | |
|---|---|---|---|---|
| GB | 2425756 | * | 11/2006 | B43L 19/00 |
| JP | 62-208984 | * | 9/1987 | B41K 3/36 |
| WO | WO2012108515 | | 8/2012 | |

*Primary Examiner* — Judy Nguyen
*Assistant Examiner* — Marissa Ferguson-Samreth

(57) ABSTRACT

A text concealing tool assembly for defacing text from a paper includes a handle and a cover that is attached to the handle. A defacing unit is rotatably mounted in the cover. The defacing unit is rolled over a paper to mark and pierce the paper such that writing on the paper is illegible.

9 Claims, 6 Drawing Sheets

(56) References Cited

U.S. PATENT DOCUMENTS

| | | | | |
|---|---|---|---|---|
| 7,194,954 | B2 * | 3/2007 | Winston | B41F 19/02 101/327 |
| 7,456,983 | B2 | 11/2008 | Meador et al. | |
| 7,963,221 | B2 | 6/2011 | Patterson | |
| D679,317 | S | 4/2013 | Ono et al. | |
| 2009/0183645 | A1 * | 7/2009 | Yonetsu | B41K 1/40 101/333 |
| 2009/0235834 | A1 * | 9/2009 | Patterson | B41K 1/22 101/352.11 |
| 2011/0192299 | A1 * | 8/2011 | Anthony | B41K 1/003 101/333 |
| 2013/0298789 | A1 * | 11/2013 | Soma | B41F 17/006 101/375 |

* cited by examiner

TEXT CONCEALING TOOL ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to text concealing devices and more particularly pertains to a new text concealing device for defacing text from a paper.

(h) BRIEF SUMMARY OF THE INVENTION

An embodiment of the disclosure meets the needs presented above by generally comprising a handle and a cover that is attached to the handle. A defacing unit is rotatably mounted in the cover. The defacing unit is configured to be rolled over a paper to mark and pierce the paper such that writing on the paper is illegible.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
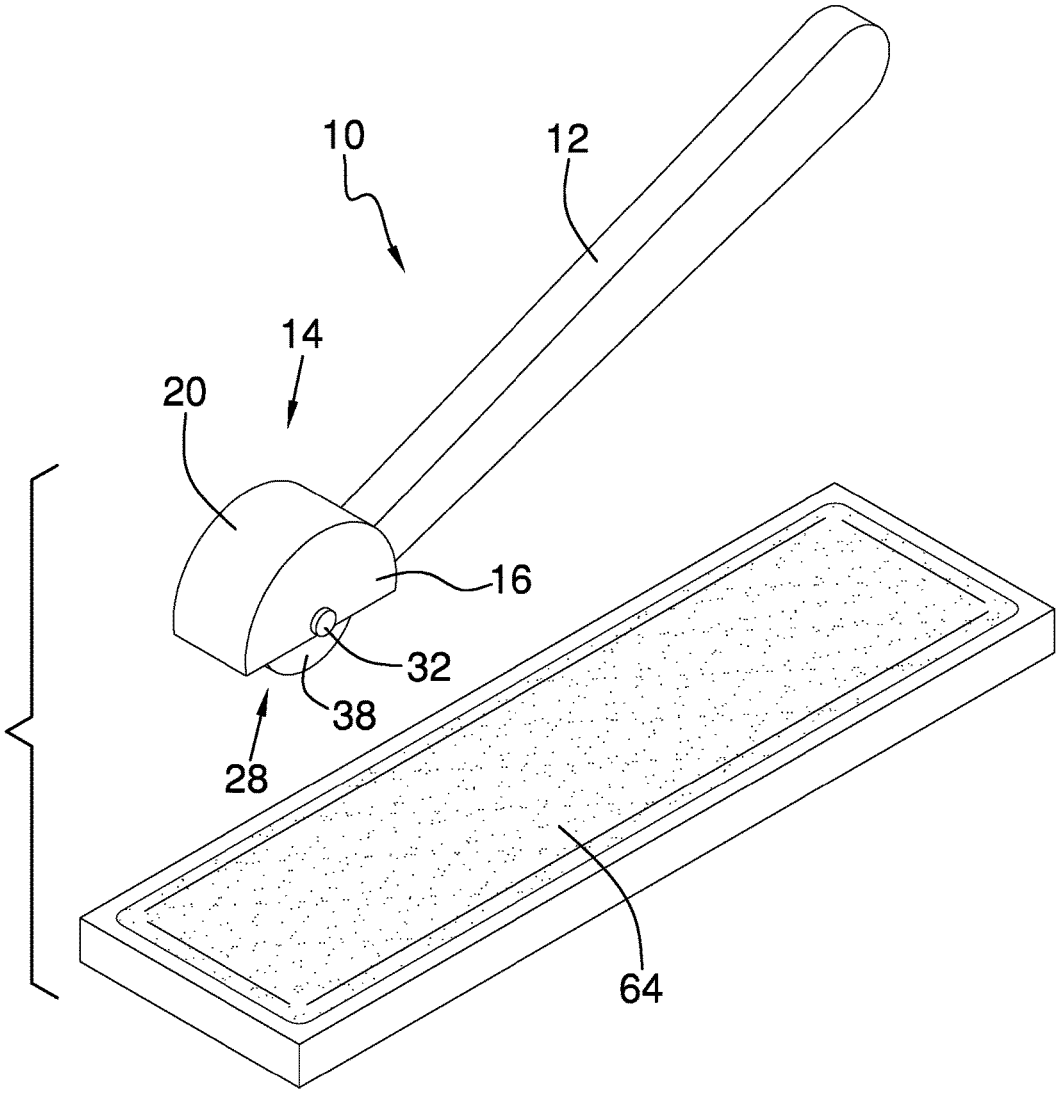
FIG. 1 is a top side view of a Text concealing tool assembly according to an embodiment of the disclosure.
Figure 2:
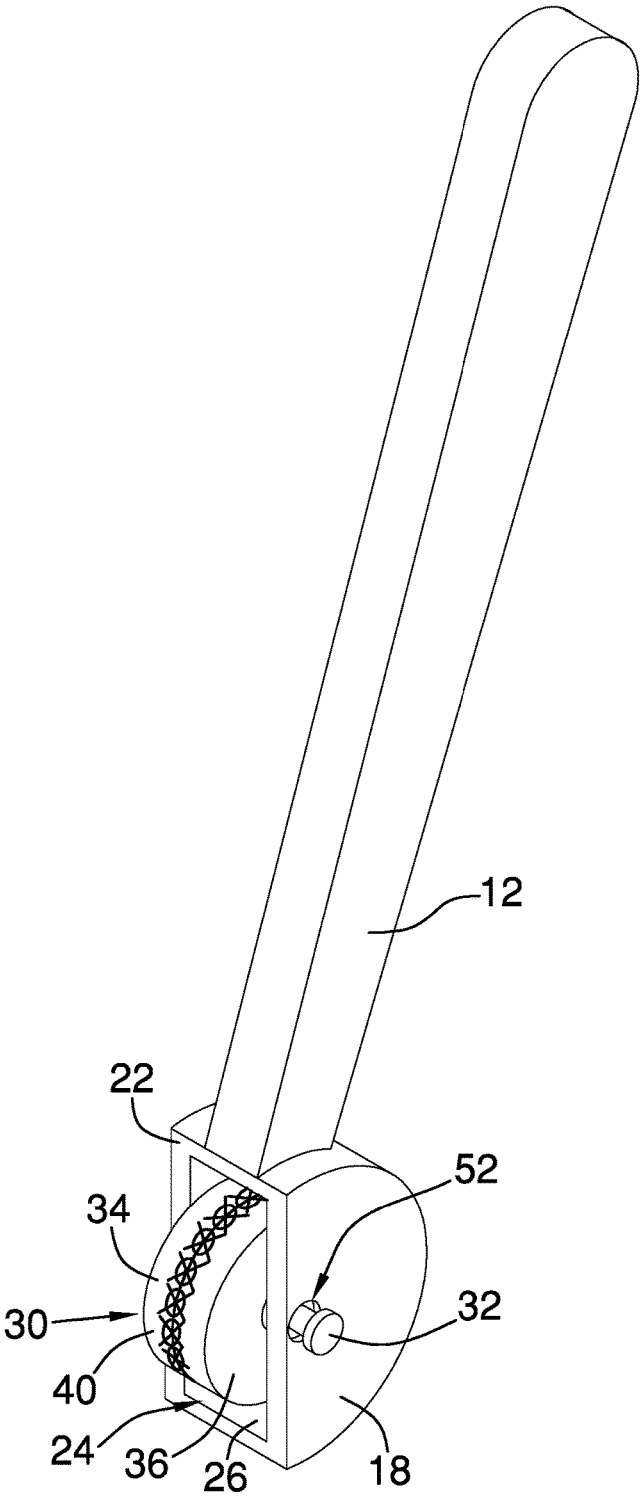
FIG. 2 is a bottom side view of an embodiment of the disclosure.
Figure 3:
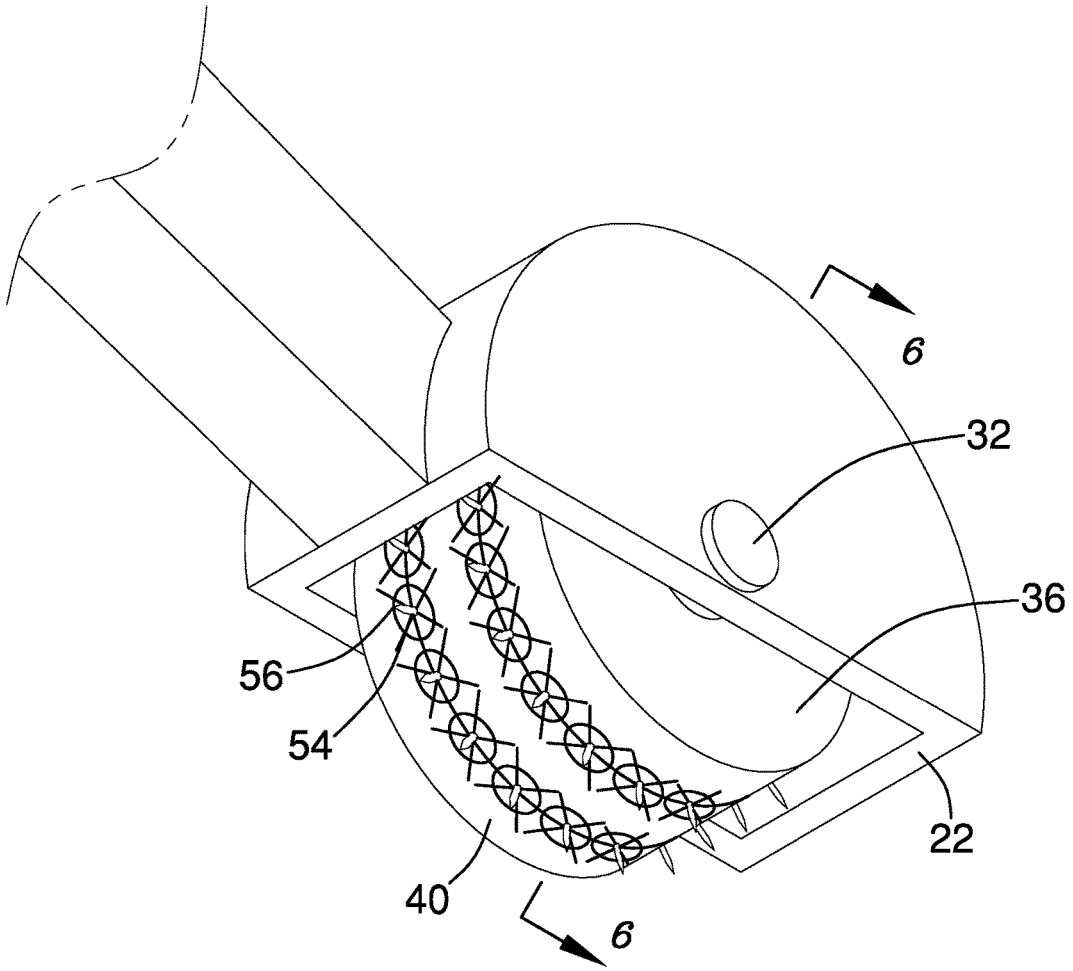
FIG. 3 is a bottom side view of an embodiment of the disclosure.
Figure 4:
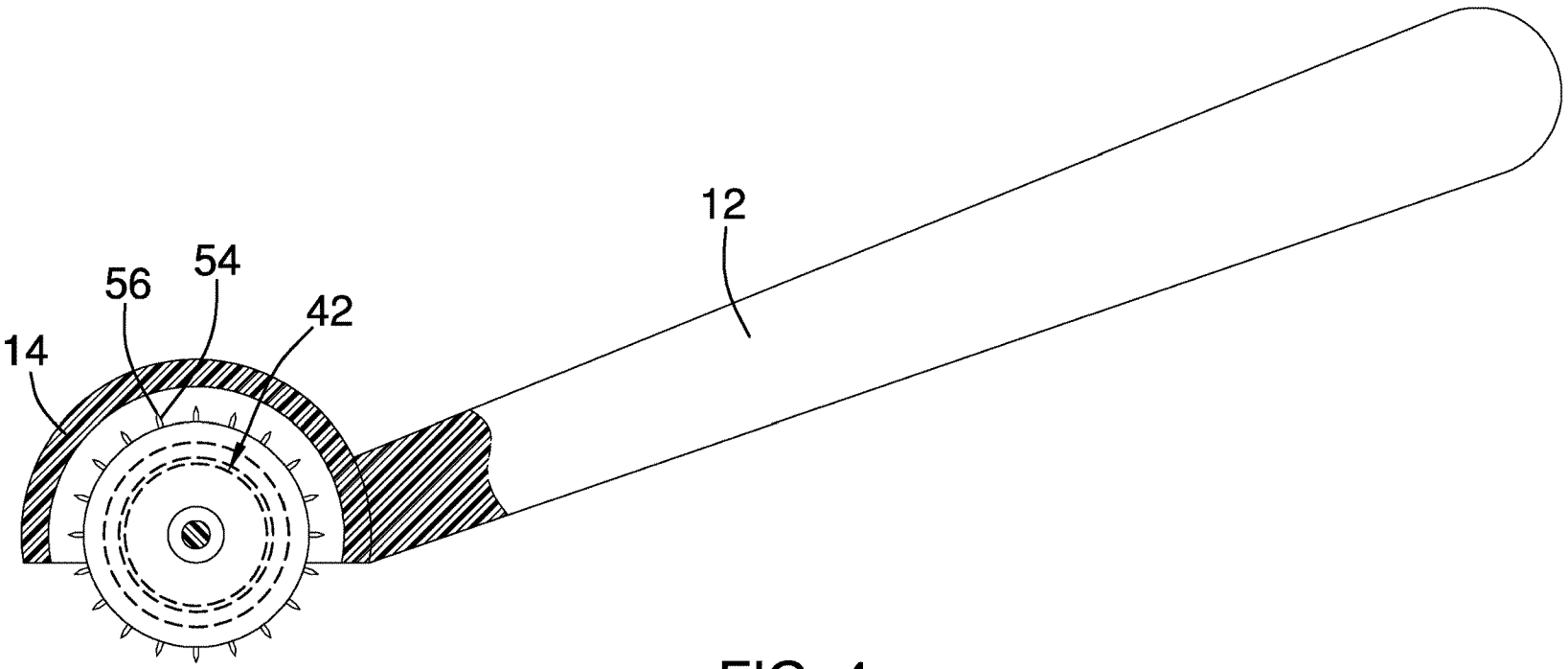
FIG. 4 is a broken side view of an embodiment of the disclosure.
Figure 6:
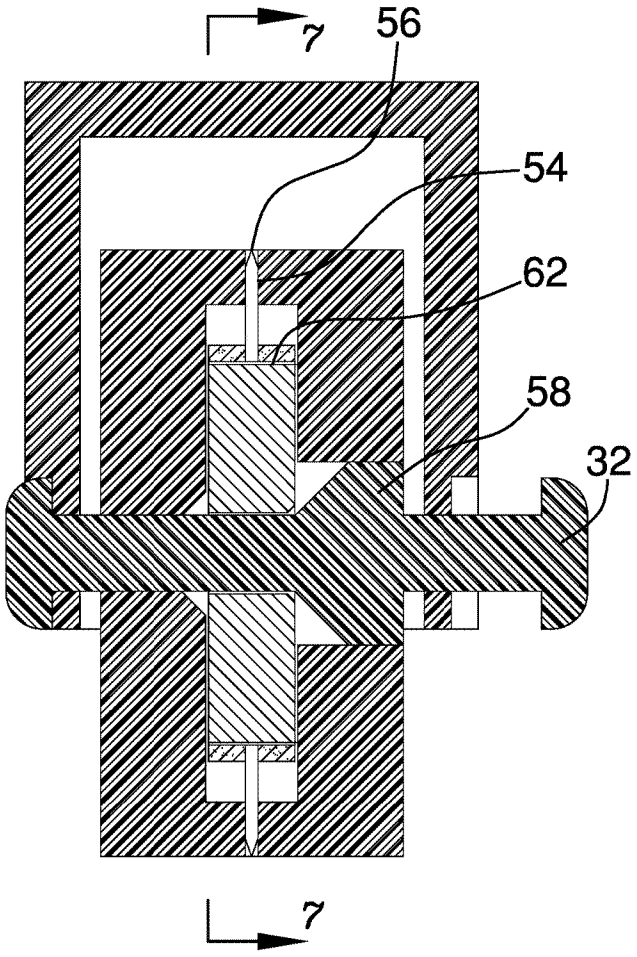
FIG. 6 is a cross-sectional view of an embodiment of the disclosure taken along line 6-6 of FIG. 3.
Figure 5:
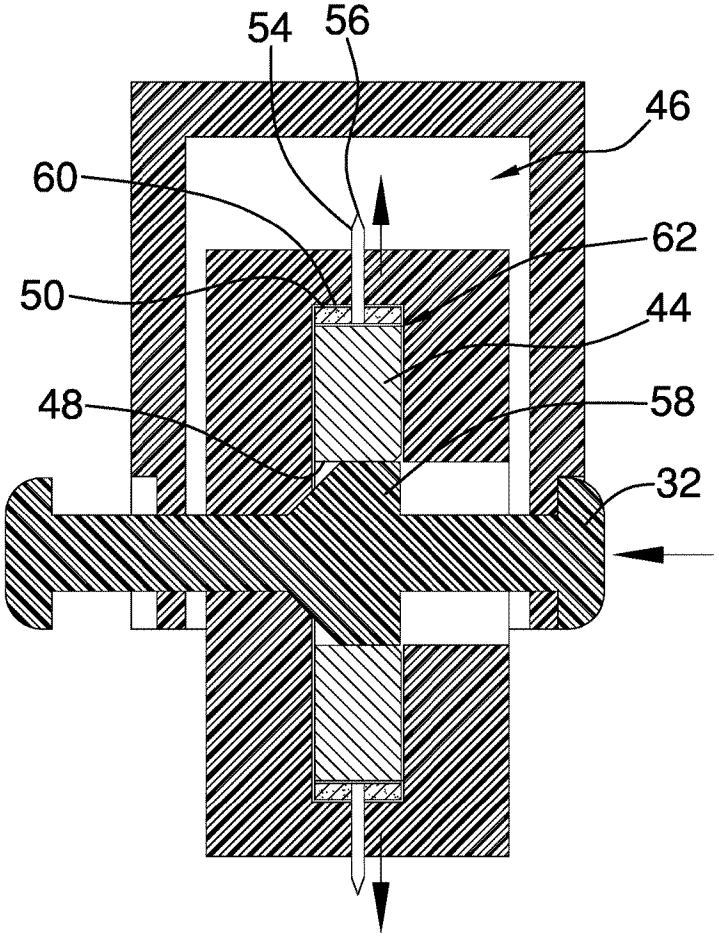
FIG. 5 is a cross-sectional view of an embodiment of the disclosure taken along line 6-6 of FIG. 3.
Figure 7:
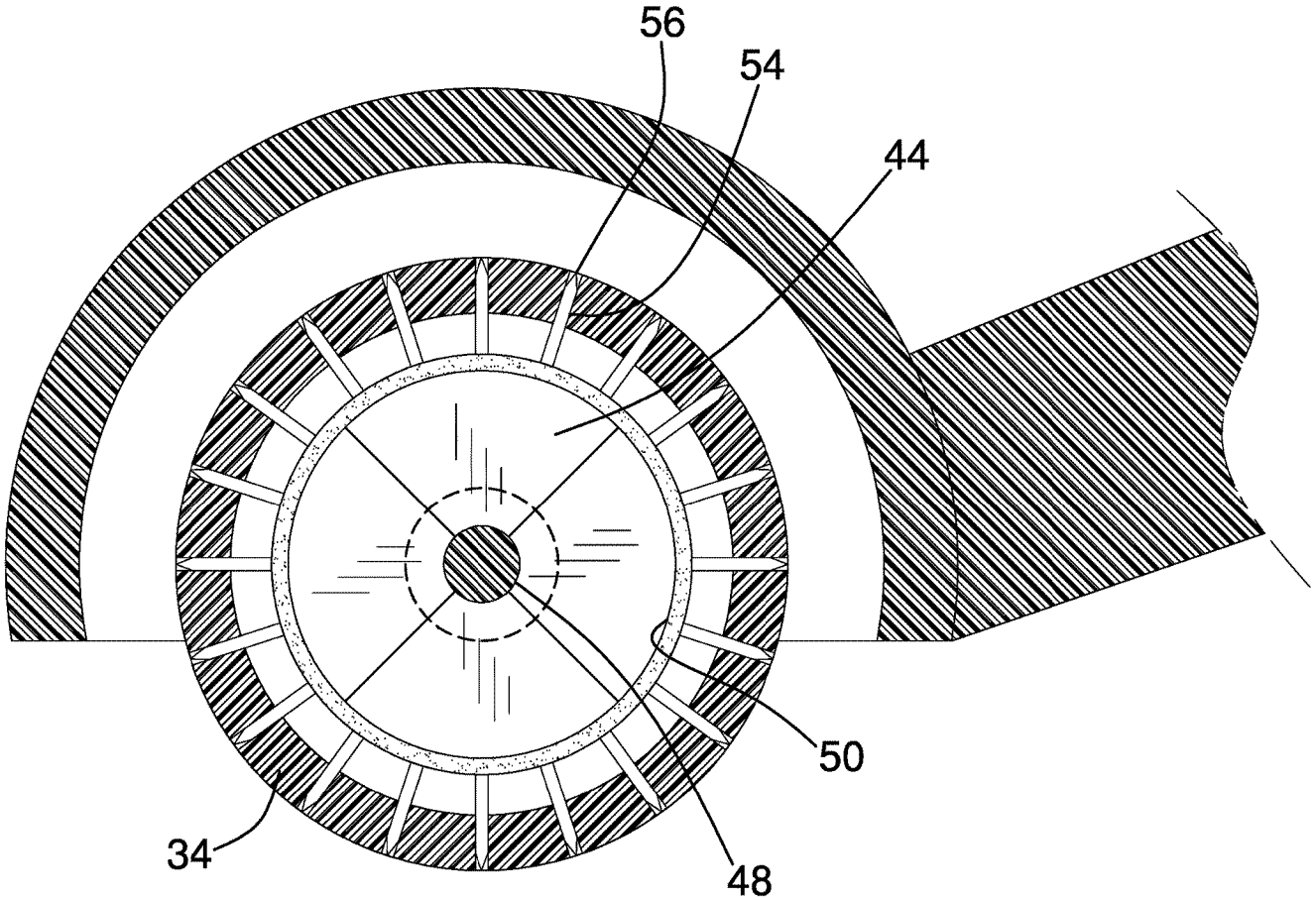
FIG. 7 is a cross-sectional view of an embodiment of the disclosure taken along line 7-7 of FIG. 6.

With reference now to the drawings, and in particular to FIGS. 1 through 7 thereof, a new text concealing device embodying the principles and concepts of an embodiment of the disclosure and generally designated by the reference numeral 10 will be described.

As best illustrated in FIGS. 1 through 7, the text concealing tool assembly 10 generally comprises a handle 12. A cover 14 is attached to the handle 12 and has a first lateral wall 16, a second lateral wall 18 and a perimeter wall 20 that is attached to and extends between the first and second lateral walls 16, 18. The first lateral wall 16, the second lateral wall 18 and the perimeter wall 20 have a shared lower edge 22 that defines an opening 24 that extends into an interior 26 of the cover 14. The perimeter wall 20 is attached to the handle 12. Additionally, the first lateral wall 16 and the second lateral walls 18 each have a semi-circular shape.

A defacing unit 28 is rotatably mounted in the cover 14. The defacing unit 28 is rolled over a paper to mark and pierce the paper such that writing on the paper is illegible. The defacing unit 28 comprises a stamping unit 30 that is rotatably mounted in the cover 14. The stamping unit 30 is rolled over the paper and continuously marks the paper when ink is applied to the stamping unit 30. An axle 32 extends through the stamping unit 30 and through the cover 14 to rotatably couple the stamping unit 30 to the cover 14. The stamping unit 30 comprises a roller 34 that has a first side 36, a second side 38 and a peripheral surface 40 that extends between the first side 36 and the second side 38. The roller 34 has a cylindrical shape and is comprised of an absorbent material that absorbs and releases ink.

A puncturing unit 42 is positioned in the stamping unit 30. The puncturing unit 42 has an expanded position that extends outwardly away from the stamping unit 30 and a retracted position wherein the puncturing unit 42 is retracted within the stamping unit 30. The puncturing unit 42 comprises a plurality of mounts 44 that is positioned within a cavity 46 within the roller 34. Each of the mounts 44 has an interior edge 48 and an exterior edge 50 wherein the interior edges 48 face each other and the exterior edges 50 face the peripheral surface 40. The axle 32 extends through an orifice 52 bounded by the interior edges 48.

A plurality of rods 54 each has a pointed free end 56. Each of the rods 54 is attached to and extends outwardly from one of the mounts 44 such that each of the mounts 44 includes multiple ones of the rods 54. Each of the rods 54 extends outwardly away from the stamping unit 30 in the extended position and is retracted within the stamping unit 30 in the retracted position. The rods 54 puncture paper when in the extended position. Each of the rods 54 may be orientated in a line, or a plurality of lines that extends arounds the exterior edge of each of the mounts 44.

The axle 32 is laterally movable through the orifice 52. The axle 32 includes a shoulder 58 that extends outwardly from the axle 32. The axle 32 shoulders 58 urge the rods 54 outwardly out of the roller 34 into the extended position when the axle 32 is moved such that the shoulder 58 engages the mounts 44. The rods 54 are movable inward to the retracted position when the axle 32 is moved such that the shoulder 58 is disengaged from the mounts 44.

A biasing member 60 engages the mounts 44 and biases the mounts 44 toward the retracted position. The biasing member 60 comprises a resiliently elastic band that extends around an outer perimeter 62 formed by the mounts 44.

An ink pad 64 is included and has ink stored thereon. The stamping unit 30 is rolled over the ink pad 64 wherein the roller 44 absorbs the ink thereon. The stamping unit 30 is rolled over the paper to release the ink onto the paper and cover the indicia printed thereon.

In use, the stamping unit 30 is rolled over the ink pad 64 such that the roller 34 absorbs ink. The puncturing unit 42 is selectively positioned in the extended positioned or the retracted position when the axle 32 is moved laterally through the orifice 52. The defacing unit 28 is then rolled over the paper, the stamping unit 30 releases ink onto the paper and, if in the extended position, the puncturing unit 42 pierces holes into the paper to deface the paper.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A defacing tool assembly for marking and removing writing on a paper, said defacing tool assembly comprising:
- a handle;
- a cover being attached to said handle; and
- a defacing unit being rotatably mounted in said cover, said defacing unit being configured to be rolled over a paper to mark and pierce the paper such that writing on the paper is illegible, said defacing unit comprising
  - a stamping unit being rotatably mounted in said cover, said stamping unit being configured to be rolled over the paper and continuously marking the paper when ink is applied to said stamping unit, said stamping unit including a roller having a first side, a second side and a peripheral surface extending between said first side and said second side, said roller having a cylindrical shape and being comprised of an absorbent material configured to absorb and release ink,
  - an axle extending through said stamping unit and through said cover to rotatably couple said stamping unit to said cover, and
  - a puncturing unit being positioned in said stamping unit, said puncturing unit having an expanded position extending outwardly away from said stamping unit and a retracted position wherein said puncturing unit is retracted within said stamping unit.

2. The defacing tool assembly according to claim 1, wherein said cover has a first lateral wall, a second lateral wall and a perimeter wall being attached to and extending between said first and second lateral walls, said first lateral wall, said second lateral wall and said perimeter wall having a shared lower edge defining an opening extending into an interior of said cover.

3. The defacing tool assembly according to claim 2, wherein said perimeter wall is attached to said handle.

4. The defacing tool assembly according to claim 2, wherein said first lateral wall and second lateral wall each has a semi-circular shape.

5. The defacing tool assembly according to claim 1, wherein said puncturing unit comprises a plurality of mounts being positioned within a cavity within said roller, said mounts each having an interior edge and an exterior edge wherein said interior edges face each other and said exterior edges face said peripheral surface, said axle extending through an orifice bounded by said interior edges.

6. The defacing tool assembly according to claim 5, wherein said puncturing unit further includes a plurality of rods each having a pointed free end, each of said rods being attached to and extending outwardly from one of said mounts such that each of said mounts includes multiple ones of said rods, each of said rods extending outwardly away from said stamping unit in said extended position and are retracted within said stamping unit in said retracted position, said rods being configured to puncture paper when in said extended position.

7. The defacing tool assembly according to claim 6, wherein said axle is laterally movable through said orifice, said axle including a shoulder extending outwardly from said axle, said axle shoulders urging said rods outwardly out of said roller into said extended position when said axle is moved such that said shoulder engages said mounts, said needs being movable inward to said retracted position when said axle is moved such that said shoulder is disengaged from said mounts.

8. The defacing tool assembly according to claim 7, wherein said puncturing unit further includes a biasing member engaging said mounts and biasing said mounts toward said retracted position, said biasing member comprising a resiliently elastic band extending around an outer perimeter formed by said mounts.

9. A defacing tool assembly for marking and removing writing on a paper, said defacing tool assembly comprising:
- a handle;
- a cover being attached to said handle, said cover having a first lateral wall, a second lateral wall and a perimeter wall being attached to and extending between said first and second lateral walls, said first lateral wall, said second lateral wall and said perimeter wall having a shared lower edge defining an opening extending into an interior of said cover, said perimeter wall being attached to said handle, said first and second lateral walls each having a semi-circular shape;

a defacing unit being rotatably mounted in said cover, said defacing unit being configured to be rolled over a paper to mark and pierce the paper such that writing on the paper is illegible, said defacing unit comprising:

a stamping unit being rotatably mounted in said cover, said stamping unit being configured to be rolled over the paper and continuously marking the paper when ink is applied to said stamping unit, an axle extending through said stamping unit and through said cover to rotatably couple said stamping unit to said cover, said stamping unit comprising: a roller having a first side, a second side and a peripheral surface extending between said first side and said second side said roller having a cylindrical shape and being comprised of an absorbent material configured to absorb and release ink;

a puncturing unit being positioned in said stamping unit, said puncturing unit having an expanded position extending outwardly away from said stamping unit and a retracted position wherein said puncturing unit is retracted within said stamping unit, said puncturing unit comprising:

a plurality of mounts being positioned within a cavity within said roller, said mounts each having an interior edge and an exterior edge wherein said interior edges face each other and said exterior edges face said peripheral surface, said axle extending through an orifice bounded by said interior edges;

a plurality of rods each having a pointed free end, each of said rods being attached to and extending outwardly from one of said mounts such that each of said mounts includes multiple ones of said rods, each of said rods extending outwardly away from said stamping unit in said extended position and are retracted within said stamping unit in said retracted position, said rods being configured to puncture paper when in said extended position;

said axle being laterally movable through said orifice, said axle including a shoulder extending outwardly from said axle, said axle shoulders urging said rods outwardly out of said roller into said extended position when said axle is moved such that said shoulder engages said mounts, said needs being movable inward to said retracted position when said axle is moved such that said shoulder is disengaged from said mounts; and a biasing member engaging said mounts and biasing said mounts toward said retracted position, said biasing member comprising a resiliently elastic band extending around an outer perimeter formed by said mounts.

* * * * *